US008177140B1

(12) United States Patent
Haydell

(10) Patent No.: US 8,177,140 B1
(45) Date of Patent: May 15, 2012

(54) METHOD AND APPARATUS FOR DRIVING, SHAPING, AND CARRYING FLUIDS

(76) Inventor: Michael Haydell, Lafayette, LA (US)

( * ) Notice: Subject to any disclaimer, the term of this patent is extended or adjusted under 35 U.S.C. 154(b) by 0 days.

(21) Appl. No.: 12/690,015

(22) Filed: Jan. 19, 2010

Related U.S. Application Data

(60) Provisional application No. 61/145,708, filed on Jan. 19, 2009.

(51) Int. Cl.
*B05B 1/24* (2006.01)
*F23D 11/16* (2006.01)

(52) U.S. Cl. ..... 239/13; 239/134; 239/419

(58) Field of Classification Search ..... 239/8, 10, 239/13, 303, 307, 310, 128, 133, 134, 398, 239/400, 413, 419, 419.3, 422
See application file for complete search history.

(56) References Cited

U.S. PATENT DOCUMENTS

| | | | | |
|---|---|---|---|---|
| 6,372,156 | B1 * | 4/2002 | Kong et al. | 252/373 |
| 7,267,130 | B2 * | 9/2007 | Okuda et al. | 134/103.2 |
| 7,455,246 | B2 * | 11/2008 | Roth et al. | 239/146 |
| 7,644,678 | B2 * | 1/2010 | Carstens et al. | 118/313 |
| 7,883,264 | B1 * | 2/2011 | Liva | 366/177.1 |
| 2004/0219079 | A1 * | 11/2004 | Hagen et al. | 422/194 |

* cited by examiner

*Primary Examiner* — Davis Hwu
(74) *Attorney, Agent, or Firm* — Onebane Law Firm; Greg R. Mier

(57) ABSTRACT

An apparatus and method for providing an atomizing, shaping and driving fluid that can be used primarily in the painting industry. The apparatus includes a first heating and cooling unit for heating or cooling the paint carrying fluid, a series of nitrogen, carbon dioxide, and argon units for adjusting the concentration of nitrogen, carbon dioxide, and argon in said fluid, a manifold for mixing and controlling the flow rate of said fluid, a second heating and cooling unit for heating or cooling the fluid exiting said manifold, and an ionization unit for adjusting ionization of the fluid exiting the second heating and cooling unit.

2 Claims, 1 Drawing Sheet

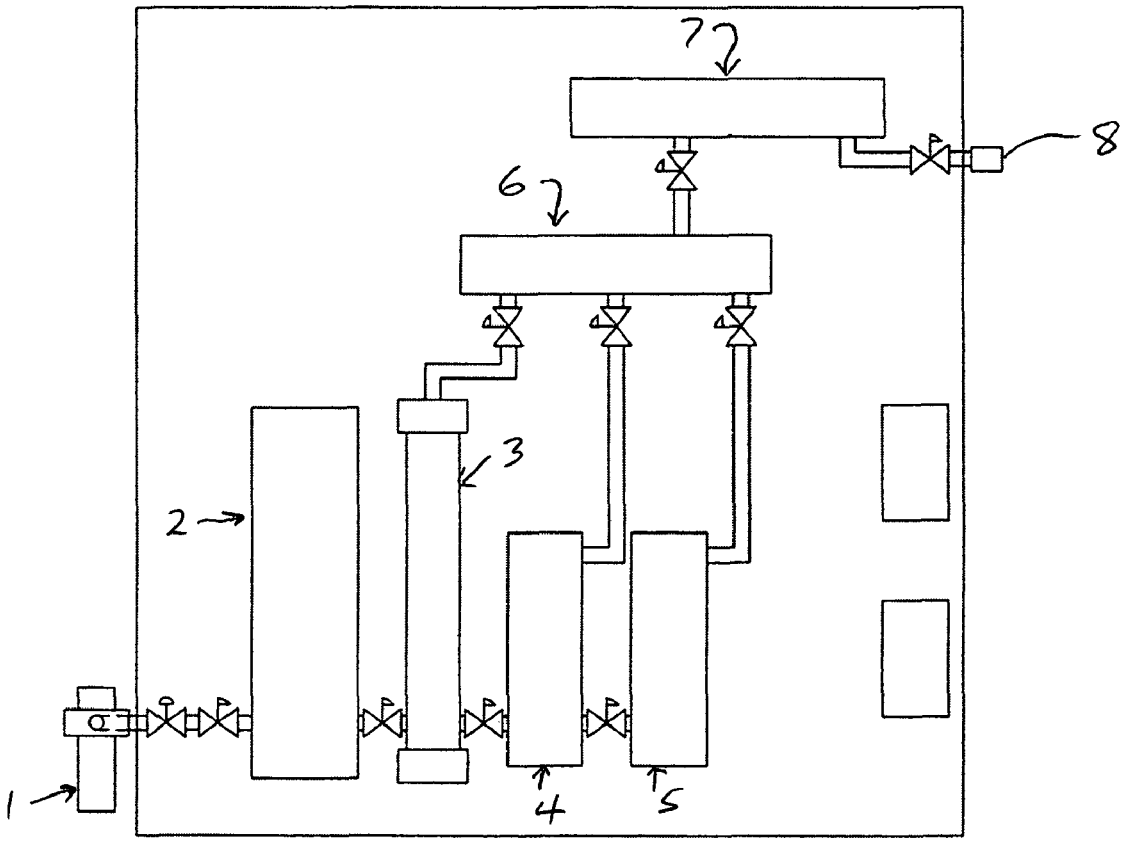
7
8
6
3
2
1
4
5

METHOD AND APPARATUS FOR DRIVING, SHAPING, AND CARRYING FLUIDS

CROSS REFERENCE TO RELATED APPLICATIONS

The present application claims priority from provision patent application No. 61/145,708, filed on Jan. 19, 2009.

FIELD OF THE INVENTION

The present invention generally relates to field of driving, shaping, and carrying of fluids used primarily, but not exclusively, in the paint application industry.

BACKGROUND

Atomizing devices of known type consist of guns or nozzles, into which a flow of pressurized air and a supply of the material to be atomized, shaped, or driven are conveyed. The air acts as a carrier, shaping assistant, or driver of the material to be atomized, entraining the material therewith and transferring, shaping, or driving the atomizer, so the material can be atomized, shaped, or device driven so material can be processed. Examples of atomizing, shaping, or driving by compressed air include rotary atomizers, air assisted airless coatings gun, HVLP and conventional coatings gun, general use spray equipment for coatings and chemicals. The applications are used in industries that produce perfumes, deodorant, chemicals, pesticides, resins, automobiles coatings, military vehicles, furniture, articles made of plastic materials reinforced by incorporated fiberglass, boats, airplanes, leather articles in general, etc.

SUMMARY OF THE INVENTION

In order to improve quality of atomizing, shaping or driving air, the pressurized air is dried to remove the condensate (making the air pass through a low-temperature refrigeration-cycle drier for example, generally until a dew-point value not lower than 3° C.) and filtered to eliminate traces of oil or other impurities (by filtering the air by means of coalescence filters or activated-carbon filters, for example).

The first aim of the present invention is to provide an atomizing, shaping and driving apparatus using controlled gas mixture, adapted to create whole new industry of Advanced Atomization, Shaping, and Driving Controlled Gas Technologies. Another aim of the present invention is to provide an apparatus and method for atomization devices, which have a high yielding and are quite reliable in terms of characteristics of the dry compressed air or gas mixture, treated to the different temperatures. Another aim of the present invention is to provide an atomization, shaping and driving apparatus of versatile use and ready adaptation in which hollow-fibre membranes are used to treat the compressed air by drying it, or hollow-fibre membranes to obtain controlled gas mixture are used alternatively or in an interchangeable manner, in both cases making it possible to operate under different pressure and temperature conditions.

BRIEF DESCRIPTION OF THE DRAWINGS

The accompanying drawing is provided for the purpose of illustration only and is not intended as a definition of the limits of the present invention. The drawing illustrates a preferred embodiment of the present invention, wherein:

FIG. 1 is a block diagram of a preferred embodiment of the present invention.

DESCRIPTION OF THE INVENTION

While the present invention will be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof) falling within the scope of the appended claims.

As shown in FIG. 1, a fluid enters the first component of the system, which is able to heat or cool in the incoming fluid. The temperature adjusted fluid is then processed through a series of units, including a nitrogen membrane, a carbon dioxide generator, and an argon generator and supply. The fluid mixture of nitrogen, argon, and carbon dioxide in a concentration from 78 to 99.9% is then processed through a manifold for fluid mixture and flow control, after which the fluid is processed through a second heating and cooling unit. According to the invention, the temperature of the controlled fluid mixture can be adjusted within the range of 0 to 250° F., obtaining a dew point which can vary from −40 to −85° F. In this way, the treated controlled gas mixture does not have oil impurities, humidity or other impurities which could be harmful to the atomizing, shaping, or driving device. The fluid mixture exiting the second heating and cooling unit is preferably ionized or de-ionized, depending on the state of ionization of the fluid mixture. The ionized or de-ionized fluid mixture can be used for atomization, shaping, and or driving the apparatus for fluid carrying according to the invention.

What is claimed is:

1. An apparatus for provide an atomizing, shaping and driving fluid, comprising:

(a) a first heating and cooling unit for heating or cooling the fluid;

(b) a series of nitrogen, carbon dioxide, and argon units for adjusting the concentration of nitrogen, carbon dioxide, and argon in said fluid;

(c) a manifold for mixing and controlling the flow rate of said fluid;

(d) a second heating and cooling unit for heating or cooling the fluid exiting said manifold; and (e) an ionization unit for adjusting ionization of the fluid exiting the second heating and cooling unit.

2. A method for providing an atomizing, shaping and driving fluid, comprising the steps of:

(a) providing a first heating and cooling unit for heating or cooling the fluid;

(b) providing a series of nitrogen, carbon dioxide, and argon units for adjusting the concentration of nitrogen, carbon dioxide, and argon in said fluid;

(c) providing a manifold for mixing and controlling the flow rate of said fluid;

(d) providing a second heating and cooling unit for heating or cooling the fluid exiting said manifold; and (e) an ionization unit for adjusting ionization of the fluid exiting the second heating and cooling unit.

* * * * *